US006684868B2

(12) United States Patent
Saga

(10) Patent No.: US 6,684,868 B2
(45) Date of Patent: Feb. 3, 2004

(54) FUEL INJECTION CONTROL APPARATUS OF INTERNAL COMBUSTION ENGINE

(75) Inventor: Tadayuki Saga, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/201,997

(22) Filed: Jul. 25, 2002

(65) Prior Publication Data

US 2003/0150441 A1 Aug. 14, 2003

(30) Foreign Application Priority Data

Feb. 12, 2002 (JP) ..... 2002-033919

(51) Int. Cl.[7] ..... F02D 41/06; F02D 4/14
(52) U.S. Cl. ..... 123/674; 123/679
(58) Field of Search ..... 123/672, 674, 123/679; 701/103, 109

(56) References Cited

U.S. PATENT DOCUMENTS 5,521,825 A * 5/1996 Unuvar et al. ..... 701/103
5,566,663 A * 10/1996 Hamburg et al. ..... 123/679
6,125,831 A * 10/2000 Yasui et al. ..... 123/674
6,470,868 B2 * 10/2002 Nakagawa et al. ..... 701/109

FOREIGN PATENT DOCUMENTS

JP 59-17259 4/1984

* cited by examiner

*Primary Examiner*—Erick Solis
(74) *Attorney, Agent, or Firm*—Sughrue Mion, PLLC

(57) ABSTRACT

There is provided a fuel injection control apparatus for an internal combustion engine, which includes an $O_2$ sensor and a feedback controller that performs a feedback control of the injection quantity of fuel to the internal combustion engine. The feedback controller performs the feedback control such that the feedback gain set at the time of starting the feedback and which gives operation constant for performing feedback until the air/fuel ratio becomes optimum, is set larger than the feedback gain set for the normal operation period and which gives operation constant for performing feedback in a stable state, and the feedback gain is changed between the control start time and the normal operation period, thereby reducing the time required to attain a stable feedback state and therefore quick transition to the stable state upon starting the control and thus enabling effective reduction of harmful components in exhaust gas.

2 Claims, 5 Drawing Sheets

FUEL INJECTION CONTROL APPARATUS OF INTERNAL COMBUSTION ENGINE

This application is based on Application No. 2002-33919, filed in Japan on Feb. 12, 2002, the contents of which are hereby incorporated by reference.

BACKGROUND OF THE INVENTION

1. Field of the Invention

The present invention relates to a fuel injection control apparatus of an internal combustion engine, and particularly, to an air/fuel ratio feedback control of the internal combustion engine.

2. Description of the Related Art

In a fuel injection control apparatus of an internal combustion engine, there is known an air/fuel ratio control in which the feedback control is conducted in accordance with an output signal from an $O_2$ sensor. In the feedback control, normally, when the state of the output signal from the $O_2$ sensor is a lean state, a computing operation that would increase injection quantity is performed, and when the state of the output signal of the $O_2$ sensor is in a rich state, a computing operation that would reduce injection quantity is performed.

FIG. 4 is a block diagram showing a construction of a fuel injection control apparatus of an internal combustion engine according to the conventional technique. In FIG. 4, reference numeral 1 denotes an $O_2$ sensor, and 2 a feedback controlling means. The feedback controlling means 2 consists of: a feedback determination means 3 for making determination whether the feedback is being performed and for making judgement between the rich state and the lean state, on the basis of the output signal from the $O_2$ sensor 1; a rich-side gain calculating means 4 and a lean-side gain calculating means 5 for calculating a gain on the basis of the determination result obtained by the feedback determination means 3; and a fuel injection quantity calculating means 6 for calculating a fuel injection quantity obtained by multiplying the gain from the gain calculating means and for outputting it. Reference numeral 7 denotes an injector driving means, which drives an injector on the basis of the output from the fuel injection quantity calculating, means 6.

Incidentally, in the above-described fuel injection control apparatus of the internal combustion engine according to the conventional technique, when the feedback control is performed in accordance with the output signal from the $O_2$ sensor, it is necessary that deviation from the target value is minimized. Therefore, the feedback gain is set to such a value that would not cause a rapid change. However, in the $O_2$ feedback control of the internal combustion engine, it is expected that the control is started in the state where there is a large gap between the air/fuel ratio at the time of starting the feedback and the target ratio for the feedback control, depending on the load conditions. Therefore, there is a problem in that it takes a lot of time to reach a stable feedback state from the control start in the case where only a normal feedback gain is prepared.

SUMMARY OF THE INVENTION

The present invention has been made to solve the above-described problem and to provide a fuel injection control apparatus of an internal combustion engine, in which the time necessary for the feedback to reach a stable feedback state from the start of the control is reduced to achieve rapid transition to the stable state, thereby enabling effective reduction of the harmful components in exhaust gas.

According to the present invention, there is provided a fuel injection control apparatus of an internal combustion engine, comprising: an air/fuel ratio detector for detecting an air/fuel ratio of exhaust gas of the internal combustion engine; and a feedback controller for conducting feedback control of the fuel injection quantity supplied to the internal combustion engine on the basis of an output signal from the air/fuel ratio detector. The feedback controller performs the feedback control in a manner such that a feedback gain set at the time of starting the feedback control, which is used for imparting operation constant for performing the feedback control in the period from the time of starting the feedback control until an optimum air/fuel ratio is reached, is set to a value larger than that of a feedback gain set for the normal operation period, which is used for imparting operation constant for performing the feedback control in a stable state so that the feedback gain is changed between the time of starting the feedback control and the normal operation period.

Thus, the feedback gain is changed between the time of starting the feedback control and the normal operation time, in performing the feedback control. Therefore, the transition from the air/fuel ratio at the time of starting the feedback control to the target air/fuel ratio is quickly achieved, thereby enabling effective reduction of harmful components in exhaust gas. Additionally, at the time of starting the feedback control, a feedback gain being different from that set for the normal operation time is employed to control a fuel injection quantity, to thereby reduce the time to reach a stable air/fuel ratio.

DETAILED DESCRIPTION OF THE PREFERRED EMBODIMENTS

Figure 1:
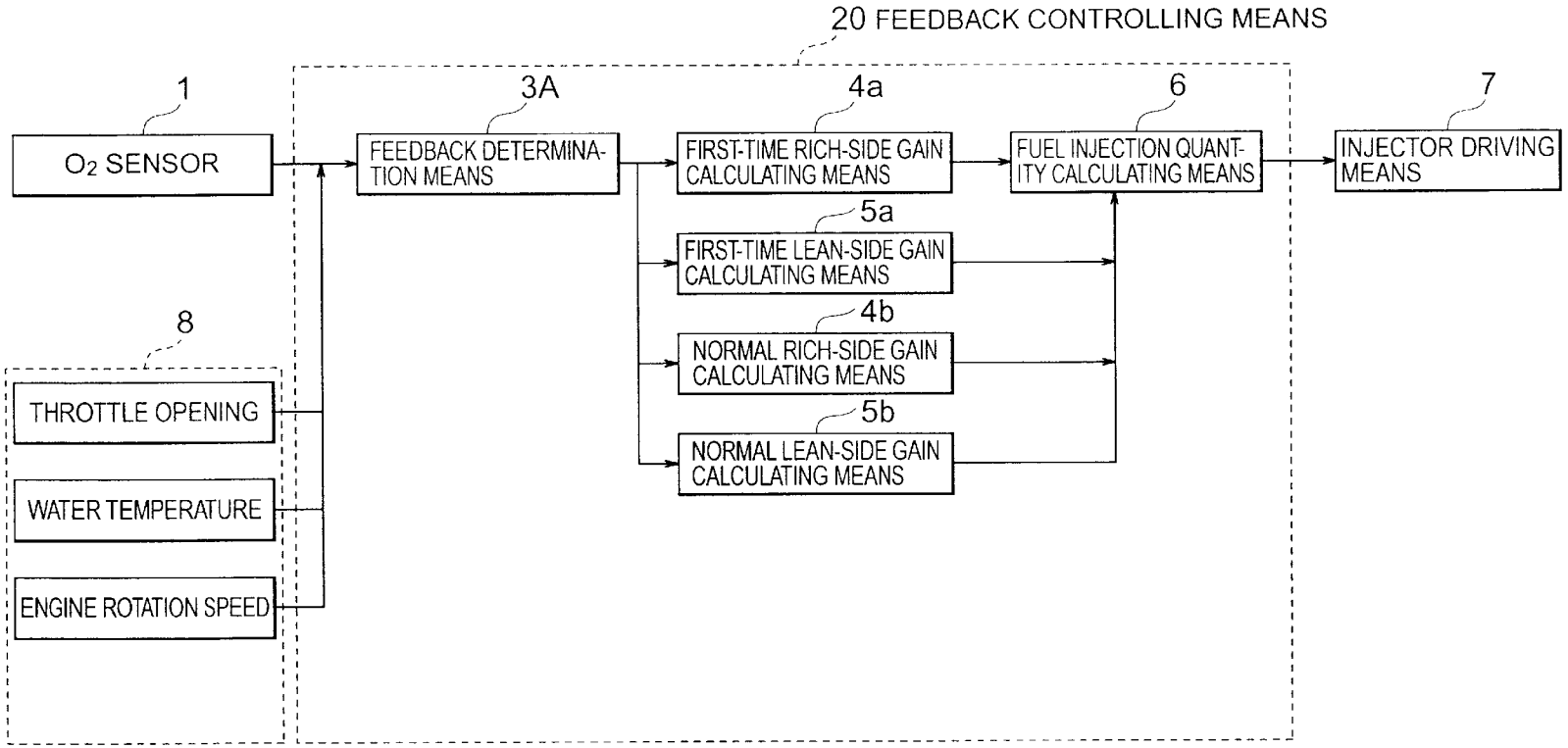
FIG. 1 is a block diagram showing a construction of a fuel injection control apparatus of an internal combustion engine according to an embodiment of the present invention.

FIG. 1 is a block diagram showing a construction of a fuel injection control apparatus of an internal combustion engine according to an embodiment of the present invention. In FIG. 1, a signal from an $O_2$ sensor 1, and a signal from control conditions 8 such as a throttle opening, water temperature, and engine rotation speed, are inputted to a feedback determination means 3A of a feedback controlling means 20 according to the present embodiment. In the feedback determination means 3A, a feedback gain set at the time of starting the feedback control, which is used for imparting operation constant to perform the feedback control from when the feedback control is started until an optimum air/fuel ratio is achieved, is set to a value larger than that of a feedback gain for the normal operation period, which is used for imparting operation constant to perform the feedback control in a stable state. Thus, the feedback determination means 3A changes the feedback gain between the time of starting the feedback control and the normal operation time, in performing the feedback control. It makes the determination whether the $O_2$ feedback has been performed, the judgement between a rich state and a lean state, and the determination whether the feedback is started for the first time.

Specifically, when the feedback determination means 3A makes determination that the feedback is performed for the first time and that the current air/fuel ratio is in a rich state, a gain from a first-time rich-side gain calculating means 4*a* is selected as the compensation coefficient for the $O_2$ feedback. The first-time rich-side gain calculating means 4*a* incorporates therein a gain correspondence table between the rotation speed and the rich or lean state, for example, and obtains from the table the gain for the rich or lean state that corresponds to the rotation speed, to thereby achieve output thereof.

Also, in a similar manner, when the feedback determination means 3A makes determination that the feedback is not for the first time but for the normal operation time and the current air/fuel ratio is in the rich state, a gain from a normal rich-side gain calculating means 4*b* is selected. When it is determined that the feedback is for the first time and the current air/fuel ratio is in the lean state, a first-time lean-side gain calculating means 5*a* is selected. When it is determined that the feedback is not for the first time but for the normal operation period and the current air/fuel ratio is in the lean state, a normal lean-side gain calculating means 5*b* is selected. Each of the gain calculating means, as in the first-time rich-side gain calculating means 4*a*, the gain for the rich or the lean state which corresponds to the rotation speed, is obtained through the incorporated gain correspondence table establishing correspondence between the rotation speed and the rich or the lean state, to thereby attain output thereof.

Thus, the compensation coefficient (gain) obtained by one of the gain calculating means 4*a*, 4*b*, 5*a*, and 5*b* is used for calculating an injection quantity by a fuel injection quantity calculating means 8. The fuel injection quantity calculating means 8 calculates the fuel injection quantity on the basis of the throttle opening, the rotation speed, and the suction pressure, etc. At this time, it calculates the fuel injection quantity by multiplying the thus obtained quantity by the compensation coefficient (gain) obtained by the gain calculating means 4*a*, 4*b*, 5*a*, or 5*b*, and then outputs it. An injector driving means 7 performs driving of an injector (not shown) on the basis of the output from the fuel injection quantity calculating means 8.

Figure 2:
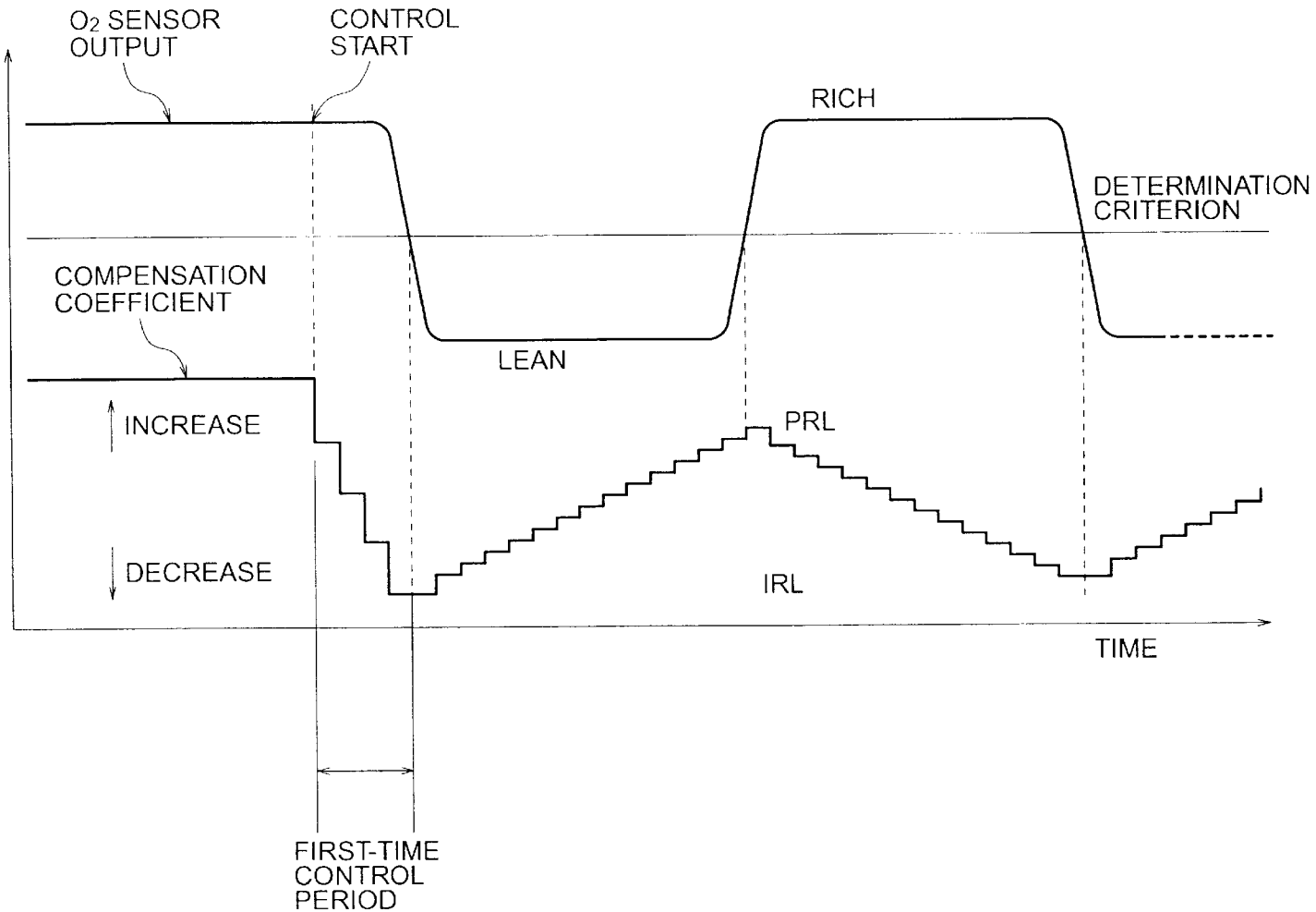
FIG. 2 is a simplified graph showing the change of a compensation coefficient (gain) from when $O_2$ feedback is performed for the first time by a feedback controlling means 20 of FIG. 1.

FIG. 2 is a simplified graph showing the change of a compensation coefficient (gain) from when the $O_2$ feedback is performed for the first time by the feedback controlling means 20. The first-time compensation coefficient, which is used for the first-time control period from when the control is started until the $O_2$ sensor output is shifted from the rich-side to the lean-side below the determination criterion for the ideal air/fuel ratio, is set to a value larger than that set for the subsequent normal operation period, as shown in FIG. 2, thereby reducing the time initially required to cause the change of the $O_2$ sensor output. In the present embodiment, a gain that is about ten times larger than that for the normal operation time is given as the first-time feedback gain. After the $O_2$ sensor output signal has experienced the above change, the feedback gain is switched to that for the normal operation period.

Figure 3:
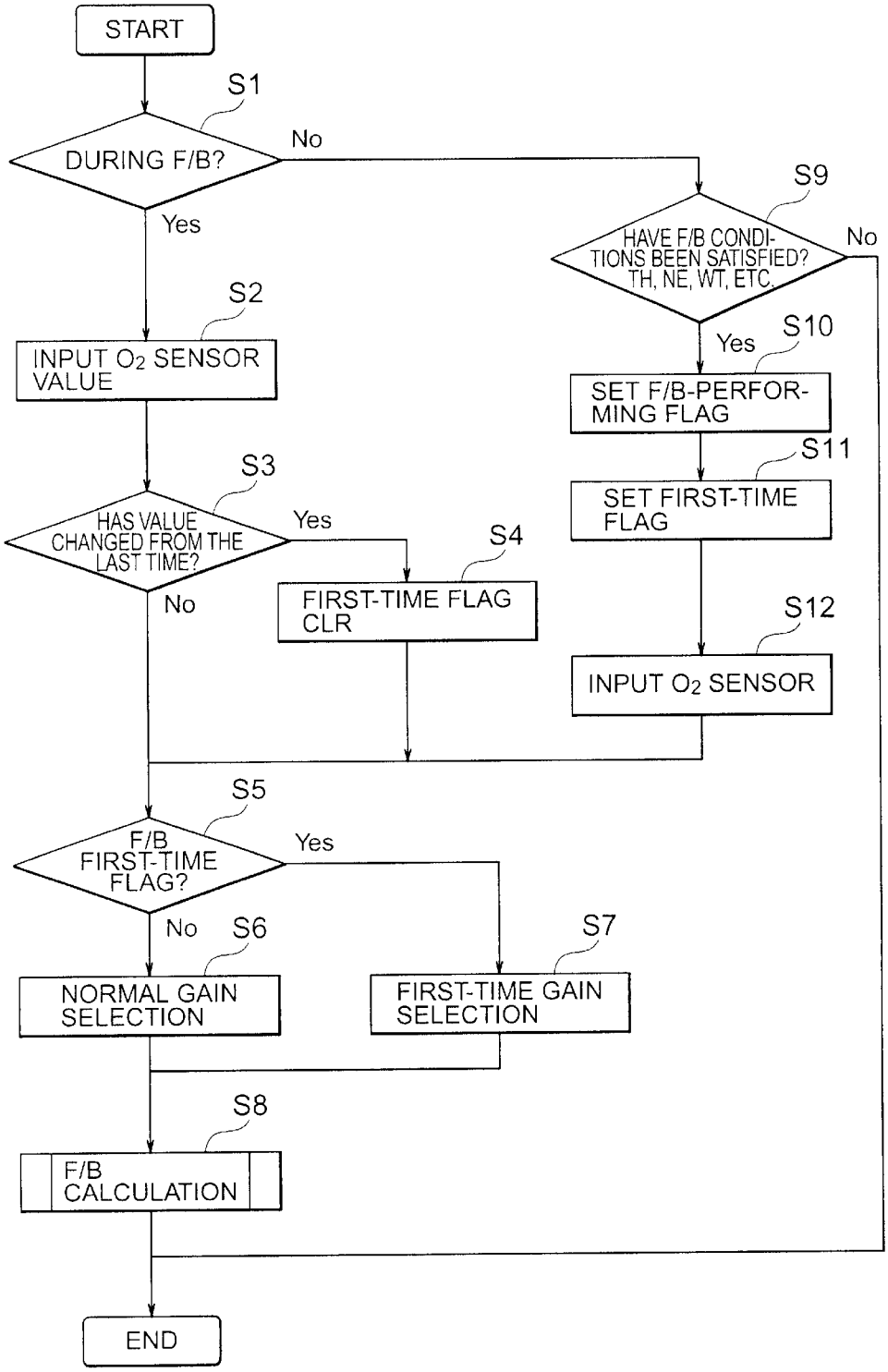
FIG. 3 is a flowchart showing schematically a content of controls performed by a feedback controlling means 20 of FIG. 1.
Figure 4:
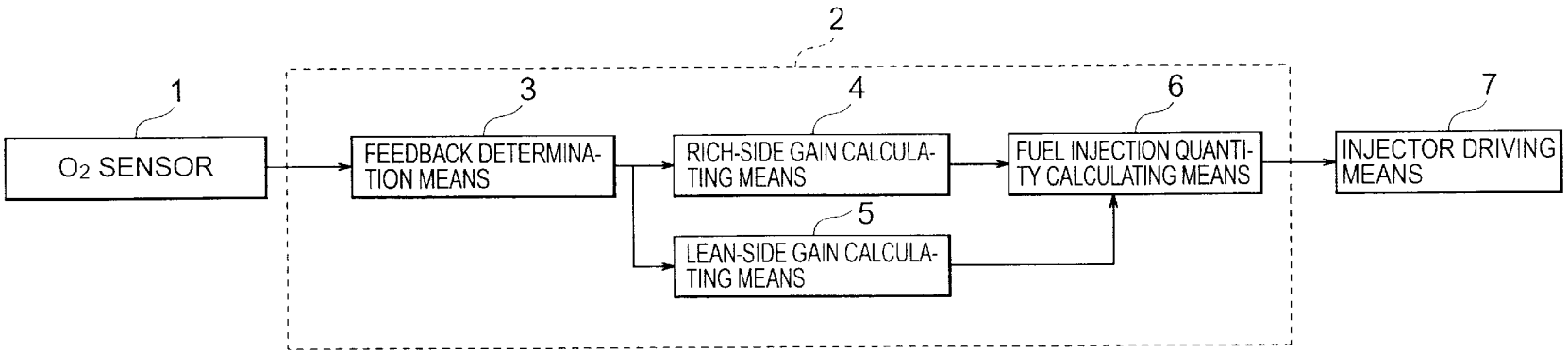
FIG. 4 is a block diagram showing a construction of a fuel injection control apparatus of an internal combustion engine according to the conventional technique.

FIG. 3 is a flowchart showing schematically a content of controls performed by the feedback controlling means 20. The feedback controlling means 20 is provided with a CPU (not shown) and performs the following processing for every operation period of the CPU. The determination whether the feedback (F/B) control is currently being performed is made at step S1. When it is determined that the feedback control is being performed, the control advances to step S2. On the other hand, when it is determined that the feedback control is not being performed, the control advances to step S9. A flag indicating performing of the feedback control is reset at the time of starting the control. Thus, the determination as to whether the feedback control is being performed can be made through the flag.

An output value of the $O_2$ sensor is detected to make judgement between the lean state and the rich state at step S2, and the control advances to step S3 to determine whether the detected value has changed from the previous detection value. Here, the term "has changed" refers to the case where the previous detection value indicated a lean state and the current detected value indicates a rich state, or the case where the previous detection value indicated a rich state and the current detected value indicates a lean state. In the case of presence of the change, the control advances to step S4. In the case of absence of the change, the control advances to step S5.

The first-time flag is cleared at step S4 and the control advances to step S5. The determination whether the feedback control is to be performed as the first-time feedback is made on the basis of the first-time flag at step S5. In the case of control for the first time, the control advances to step S7, and in the case other than that, the control advances to step S6. A feedback gain for the first-time control is imparted at step S7. A feedback gain for the normal feedback control is imparted at step S6. An $O_2$ feedback coefficient is calculated at step 8.

Also, when it is determined at step S1 that the feedback control is being performed, the control advances to S9. Then, a determination as to whether conditions for the feedback control are satisfied is made at step S9. That is, it determines whether the throttle opening TH, the engine rpm NE, and the intake pipe pressure WT exceed their respective predetermined values. When all of them exceed the respective predetermined values, that is, when the conditions for the feedback control are satisfied, the control advances to step S10. When the feedback control conditions are not satisfied, the control ends.

The flag indicating performing of the feedback is set at step S10, and the control advances to step S11. The flag indicating first-time feedback is set at step S11, and the control advances to step S12. The value of the $O_2$ sensor is detected, and the judgement between the lean state and the rich state is made at step S12, and then the control advances to S5.

Figure 5:
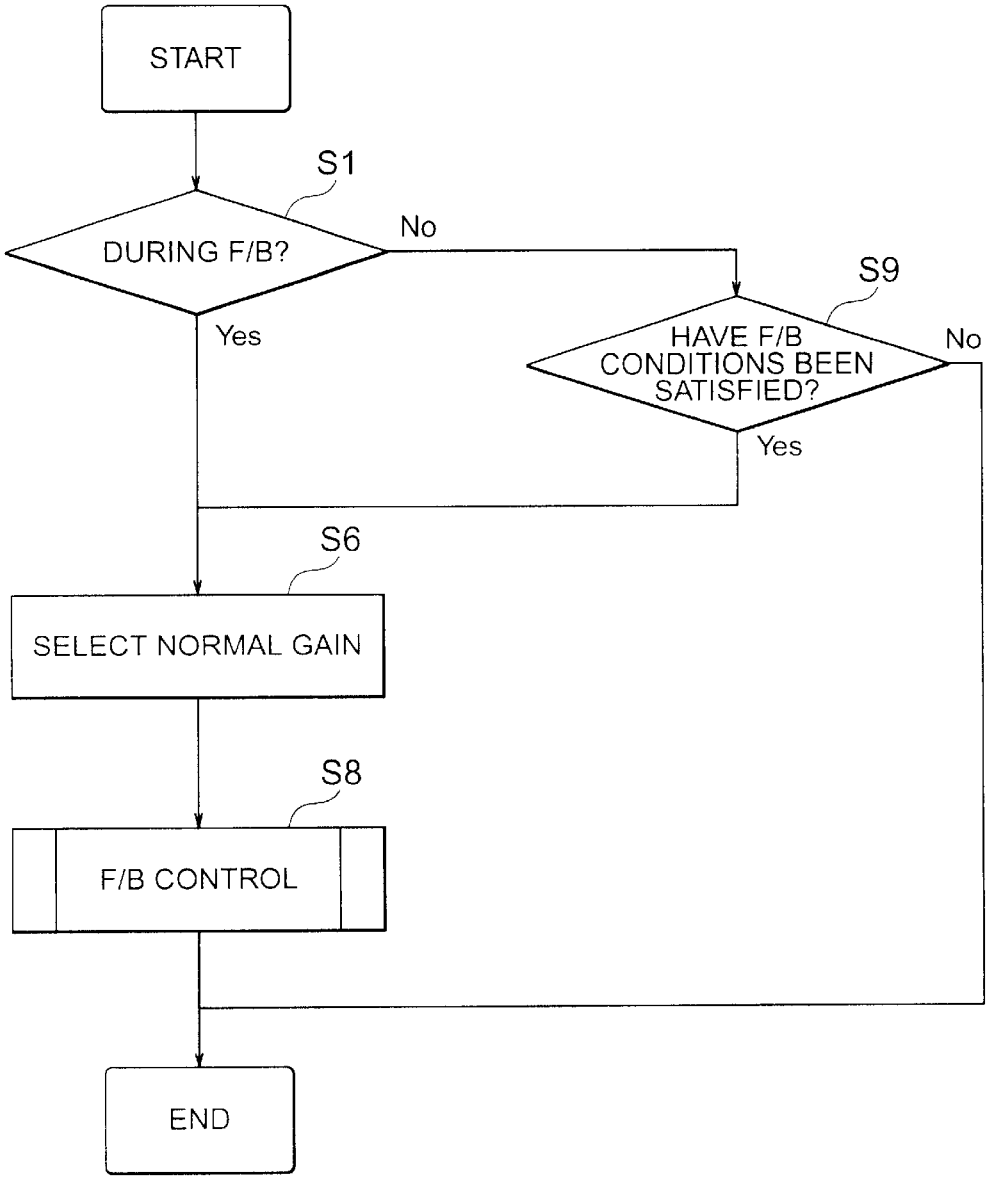
FIG. 5 is a flowchart showing a control content according to the conventional technique, shown in comparison with the flowchart of FIG. 3.

FIG. 5 is a flowchart showing a control content according to the conventional technique, shown in comparison with the content of controls performed by the feedback controlling means 20 shown in the above-described flowchart of FIG. 3. As shown in FIG. 5, the conventional control does not include the controls performed at steps S2 to S5, step 7, and steps S10 to S12 of FIG. 3. Thus, the conventional control only employs the normal feedback gain, with the result that it takes a lot of time for the feedback to reach a stable feedback state from the control start. In the present embodiment, however, the state of the $O_2$ sensor is checked at the time when the feedback control is established, and for the period until the transition of the feedback control state is achieved, the control is conducted with the feedback gain that is different from one used for the normal operation period, to thereby allow a rapid transition to the stable state. Therefore, the transition from the air/fuel ratio at the time of starting the feedback control to the target air/fuel ratio is quickly achieved, to thereby enable effective reduction of harmful components in exhaust gas.

As described above, according to the present invention, a feedback gain set at the time of starting the feedback control, which is used for imparting operation constant to perform the feedback control from the time of starting the feedback control until an optimum air/fuel ratio is reached, is set to a value larger than that of a feedback gain set for the normal operation time, which is used for imparting operation constant to perform the feedback control in a stable state. Thus, the feedback gain is changed between the time of starting the feedback control and the normal operation time, in performing the feedback control. Therefore, the transition from the air/fuel ratio at the time of starting the feedback control to the target air/fuel ratio is quickly achieved, thereby enabling effective reduction of harmful components in exhaust gas. Additionally, at the time of starting the feedback control, a feedback gain being different from that set for the normal operation time is employed to control a fuel injection quantity, to thereby reduce the time to reach a stable air/fuel ratio.

What is claimed is:

1. A fuel injection control apparatus of an internal combustion engine, comprising:

an air/fuel ratio detecting means for detecting an air/fuel ratio of exhaust gas from the internal combustion engine; and a feedback controlling means for performing feedback control of the injection quantity of fuel supplied to the internal combustion engine on the basis of an output signal from the air/fuel ratio detecting means, wherein the feedback controlling means performs the feedback control in such a way that a feedback gain set at the time of starting the feedback control, which is used for imparting operation constant for performing the feedback control in the period from the time of starting the feedback control until an optimum air/fuel ratio is reached, is set to a value larger than that of a feedback gain set for the normal operation time, which is used for imparting operation constant for performing the feedback control in a stable state, so that the feedback gain is changed between the time of starting the feedback control and the normal operation time.

2. The fuel injection control apparatus of an internal combustion engine according to claim 1, wherein the feedback controlling means includes:

a feedback determination means for determining whether the feedback is being performed, whether the air/fuel ratio is in a rich or lean state, and whether the feedback is to be started for the first time, on the basis of an output signal from the air/fuel ratio detecting means, a throttle opening, water temperature, and engine rotation speed;

gain calculating means for calculating one of a first-time rich-side gain, a first-time lean-side gain, a normal rich-side gain, and a normal lean-side gain, depending on a result of the determination by the feedback determination means; and a fuel injection quantity calculating means for calculating the fuel injection quantity on the basis of an output obtained from the gain calculating means.

* * * * *